US011459860B2

(12) United States Patent
Archa et al.

(10) Patent No.: US 11,459,860 B2
(45) **Date of Patent: *Oct. 4, 2022**

(54) TUBING AND ANNULAR GAS LIFT

(71) Applicant: Liberty Lift Solutions, LLC, Houston, TX (US)

(72) Inventors: William Garrett Archa, Decatur, TX (US); Corbin Mozisek, Richmond, TX (US)

(73) Assignee: Liberty Lift Solutions, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/162,593

(22) Filed: Jan. 29, 2021

(65) Prior Publication Data

US 2021/0148201 A1 May 20, 2021

Related U.S. Application Data

(60) Continuation of application No. 16/945,102, filed on Jul. 31, 2020, now Pat. No. 10,982,514, which is a division of application No. 16/374,544, filed on Apr. 3, 2019, now Pat. No. 10,760,385, which is a continuation-in-part of application No. 15/916,256, filed on Mar. 8, 2018, now Pat. No. 10,502,037.

(51) Int. Cl.
*E21B 43/12* (2006.01)

(52) U.S. Cl.
CPC ..... *E21B 43/122* (2013.01)

(58) Field of Classification Search
CPC .. E21B 43/122; E21B 43/123; E21B 43/1235; E21B 43/13
See application file for complete search history.

(56) References Cited

U.S. PATENT DOCUMENTS

| | | | |
|---|---|---|---|
| 3,630,640 | A | 12/1971 | McMurry et al. |
| 10,883,350 | B2 | 1/2021 | Shen et al. |
| 2009/0194293 | A1 | 8/2009 | Stephenson et al. |
| 2016/0145982 | A1 | 5/2016 | Otta et al. |

FOREIGN PATENT DOCUMENTS

| | | | |
|---|---|---|---|
| CA | 1206090 | A | 6/1986 |

OTHER PUBLICATIONS

Bravo Natural Resources—Owl Road, Annular Flow Unloading Design, 2016, 29 pages.

(Continued)

*Primary Examiner* — Kristyn A Hall
(74) *Attorney, Agent, or Firm* — The Kubiak Law Firm, PLLC

(57) ABSTRACT

A gas lift system may be installed within a well to allow gas lift operations where gas may be injected into the annular area of the well while producing fluids through the interior of the production tubular or upon demand may be reversed so that gas may be injected into the interior of the production tubular while producing fluids to the annular region of the well. In order to allow bidirectional production on demand two types of gas lift mandrels are installed as part of the production tubular. Both types of gas lift mandrels are configured such that gas lift valves are mounted to the exterior of the mandrels. In order to facilitate the desired direction of gas flow through the two types of gas lift mandrels a plug and packer system with or with out one way valves may be utilized to direct and contain the pressurized gas flow within the well.

1 Claim, 13 Drawing Sheets

(56) References Cited

OTHER PUBLICATIONS

Blann, J.R. and Williams, J.D. 1984. Determining the Most Profitable Gas Injection Pressure for a Gas Lift Installation (includes associated papers 13539 and 13546 ). J Pet Technol 36 (8): 1305-1311. SPE-12202-PA. http://dx.doi.org/10.2118/12202-PA.
Vogel, J.V. 1968. Inflow Performance Relationships for Solution-Gas Drive Wells. J Pet Technol 20 (1): 83-92. SPE 1476-PA. http://dx.doi.org/10.2118/1476-PA.
Orkiszewski, J. 1967. Predicting Two-Phase Pressure Drops in Vertical Pipe. J Pet Technol 19 (6): 829-838. SPE-1546-PA. http://dx.doi.org/10.2118/1546-PA.
Hagedorn, A.R. and Brown, K.E. 1964. The Effect of Liquid Viscosity in Two-Phase Vertical Flow. J Pet Technol 16 (2): 203-210. SPE-733-PA. http://dx.doi.org/10.2118/733-PA.
Beggs, D.H. and Brill, J.P. 1973. A Study of Two-Phase Flow in Inclined Pipes. J Pet Technol 25 (5): 607-617. SPE-4007-PA. http://dx.doi.org/10.2118/4007-PA.
Hernandez, A. (2016): Fundamentals of Gas Lift Engineering, Well Design and Troubleshooting. ISBN 978-0-12-804133-8 Gulf Professional Publishing, Cambridge, MA, 966p.
McMurry-Hughes Standard Mandrels; McMurry-Hughes Price List (Jun. 1, 1984).
Annular Gas Lift Well Design (2010).
Capsule for Annular Flow (2010).
Annular Gas Lift Well Design (2017).
Schlumberger, Gas Lift Design and Technology, 2000.
ANSI/API Specification 19G1, First Ed. Nov. 1, 2010. Side Pocket Mandrels.
Petroleum Technology Company AS, 2015, Gas-Lift Well Design.
McMurry-Macco Lift Systems Catalog (Apr. 1996) 40 pgs.
Monarch Lift Systems, Inc.: Monarch Standard Gas Lift Valves; Monarch Standard Gas Lift Mandrels (1986) 3 pgs.

TUBING AND ANNULAR GAS LIFT

CROSS-REFERENCE TO RELATED APPLICATIONS

This application claims priority to U.S. patent application Ser. No. 16/945,102 that was filed on Jul. 31, 2020, U.S. patent application Ser. No. 16/374,544 that was filed on Apr. 3, 2019, and U.S. patent application Ser. No. 15/916,256 that was filed on Mar. 8, 2018.

BACKGROUND

Generally when a well is drilled at least one hydrocarbon bearing formation is intersected. Part of the process of completing the well includes installing a liner within the well where the liner also intersects the hydrocarbon bearing formation. Once the liner is in place ports are opened up through the liner so that fluids, usually at least water and oil, may flow from the hydrocarbon bearing formation to the interior of the liner. In a newly completed well, in many instances, there is sufficient pressure within the hydrocarbon bearing formation to force the fluid from the hydrocarbon bearing formation to the surface. After some period of time the pressure gradient drops to the point where the fluids from a hydrocarbon bearing formation are no longer able to reach the surface.

Once the fluids are no longer able to naturally reach the surface artificial lift may be employed. One form of artificial lift is known as gas lift. Gas lift involves, at various downhole points in the well, injecting gas into the central passageway of the production tubing string to lift the well fluid in the string. The injected gas, which is lighter than the well fluid displaces some amount of well fluid in the string. The displacement of the well fluid with the lighter gas reduces the hydrostatic pressure inside the production tubing string and allows the reservoir fluid to enter the wellbore at a higher flow rate.

In a conventional gas lift operation a production tubular is assembled on the surface and includes a packer and a number of gas lift mandrels. Each mandrel has a check valve and a conventional injection pressure operated gas lift valve.

The production tubular is then run into the well so that the packer may be set at some point above the ports in the liner that provide access to the hydrocarbon bearing formation. Once the packer is set fluid may flow from a hydrocarbon bearing formation into an annular area between the liner and the production tubular. The packer prevents the fluid from flowing into the annular area above the packer however the fluid may flow to the bottom of the production tubular and into the production tubular. Once the fluid is in the production tubular it may flow upwards to a level dependent upon the hydrocarbon bearing formation pressure gradient. The fluid in the production tubular will generally flow up past the annular packer and will flow upwards past at least one of the side pocket mandrels. Each check valve in the side pocket mandrels prevents the fluid within the production tubular from flowing through the side pocket mandrel and into the annular area above the packer.

In order to begin producing the fluid to the surface, high-pressure gas such as nitrogen is injected into the annular area between the liner and the production tubular. The only outlet for the high-pressure gas is through the gas lift valves into the gas lift mandrels and then into the interior of the production tubular. As the high-pressure gas reaches the gas lift valve the high-pressure gas flows into the gas lift valve through ports in the side of the gas lift valve. The ports are located between the gas lift valve seat and the bellows. The high-pressure gas acts on the bellows adapter and the bellows compressing the bellows which in turn lifts the ball off of the seat. With the ball off of the seat the high-pressure gas is able to flow through the seat into the check valve. The high-pressure gas then acts upon the check valve, where the check valve has a check dart that the high pressure gas compresses against a spring lifting the check dart off of a check pad allowing the high-pressure gas to flow through the check valve and into the gas lift mandrel. As the gas flows out of the gas lift mandrel and into the interior of the production tubular adjacent the gas lift mandrel the high-pressure gas causes the fluid to become a froth. The effect is similar to blowing bubbles into milk through a straw. The column of fluid which is now froth has a much lower density and therefore a lower head pressure than a pure liquid column. The natural formation pressure in conjunction with the flow of high pressure gas now flowing upward through the production tubular lifts the froth, and thus the hydrocarbons and other fluid, to the surface.

SUMMARY

Generally an operator may utilize a gas lift system wherein high-pressure gas is injected into a well in the annular area between the casing and the production tubular. The gas then enters the production tubular at intervals along the production tubular in order to lift any liquid within the production tubular to the surface. However in certain instances it has been found advantageous to be able to reverse the high-pressure gas injection and therefore the lift direction. The high pressure gas is injected into the production tubular where the gas then flows through the production tubular and into the well where at predetermined points along the production tubular the high pressure gas is directed through a gas lift mandrel having a gas tight chamber and into the annular area between the production tubular and the casing.

More specifically a system has been envisioned where a production tubular is assembled on the surface. In order to facilitate production through the tubular to the surface a series of gas lift mandrels are installed as a part of the production string. The gas lift mandrels are spaced some preset distance apart from one another along the length of the production string. Each mandrel includes an externally mounted check valve and an externally mounted gas lift valve. The production tubular with the gas lift mandrels are then installed within the well. Each check valve prevents flow of any fluid or gas including the high-pressure injected gas, within the production tubular into the annular area between the production tubular and casing. The gas lift valve tends to prevent the flow of high pressure gas from the annular region into the production tubular until a particular preset pressure is reached. Upon reaching the preset pressure the system allows high-pressure gas to be injected into the production tubular.

In order to allow reverse flow, as may be required or desired by the operator, when that same system described above is assembled on the surface, an additional, different set of gas lift mandrels is installed as part of the same production string. The second set of gas lift mandrels has an external, gas tight chamber where a flow path through the external, otherwise gas tight chamber is through a check valve and a gas lift valve both installed within the external, gas tight chamber. The second set of gas lift mandrels allow high-pressure gas to be injected into the interior of the production tubular from the surface. As the high-pressure gas reaches the second set of mandrels the high-pressure gas flows through a port from the interior of the mandrel into the external, gas tight chamber. The high-pressure gas then surrounds the gas lift valve. The gas lift valve prevents the high-pressure gas from flowing from the external chamber into the annular area of the well between the production tubular and the casing until the pressure within the external chamber reaches up a particular preset pressure. Upon reaching the particular preset pressure the gas within the external chamber causes the gas lift valve to open allowing the high-pressure gas to flow from the external chamber through the check valve and into the annular region of the well between the production tubular and the casing. The check valve is typically placed between the gas lift valve and the annular region of the well preventing any fluid or gas, including high-pressure gas, in the annular region of the well from flowing into the gas lift valve, the external chamber, and the interior of the production tubular.

By having a first set of exterior mounted gas lift valves that allow gas to be injected from the annulus into the interior of the production tubular while also having a second set of exterior mounted gas lift valves that allow gas to be injected from the interior of the production tubular into the annular area between the production tubular and the casing or wellbore an operator can produce fluid in either direction as required by well conditions. The first set of exterior mounted valves include a check valve that prevent the flow of high pressure gas or fluid from the interior of the production tubular into the annular area. The second set of exterior mounted valves include an exterior gas tight chamber having a flow path that forces all flow through the gas lift valve and the check valve. In the second set of exterior mounted valves however the check valve prevents the flow of high pressure gas or fluid from the annular area into the interior of the production tubular.

Advantages and other features of the invention will become apparent from the following drawing, description and claims.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
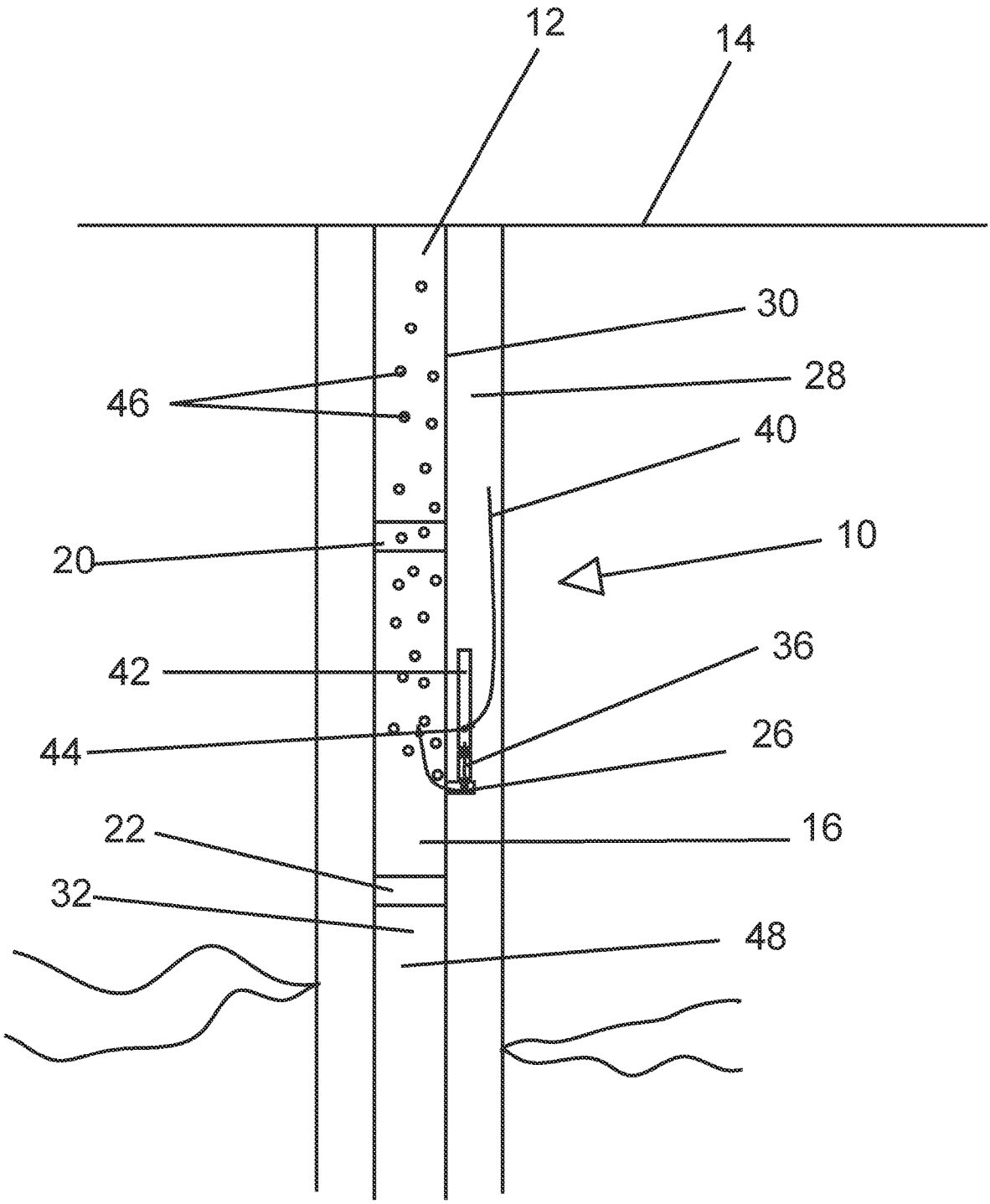
FIG. 1 depicts a gas lift system using high pressure gas injected into the annular area to assist in moving fluids in the interior of the tubular to the surface.

FIG. 1 depicts a gas lift system 10 where a production tubular 12 running from the surface 14 has a gas lift mandrel 16 assembled into the production tubular 12 using collars 20 and 22. The gas lift mandrel 16 includes a port 24 that provides access from the annular region 26, between the casing 28 and the exterior of the production tubular 30, to the interior of the production tubular 32. The check valve 36 is a one-way valve that is oriented to prevent oil or gas, including high-pressure gas, from flowing through this particular mandrel from the interior of the production tubular 32 to the exterior of the production tubular 30 while allowing the flow of fluid or gas from the annular region 26 to the interior of the production tubular 32.

In operation this particular configuration of the gas lift system 10 utilizes high-pressure gas as depicted by arrow 40 injected into the annular region 26 which then flows to gas lift valve 42 and into port 44 in gas lift valve 42 to enter the interior of gas lift valve 42. The gas then flows through gas lift valve 42 towards check valve 36. The high-pressure gas causes check valve 36 to open allowing the flow of high pressure gas from the annular region 26 to the interior of the production tubular 32. The high-pressure gas then enters the interior of the production tubular 32 forming areas of lower density 46. The areas of lower density 46 may be commonly referred to as bubbles. The bubbles 46 are utilized to reduce the density of the column of fluid 48 within the production tubular 12 so that the natural reservoir pressure may lift the column of fluid and bubbles to the surface.

Figure 2:
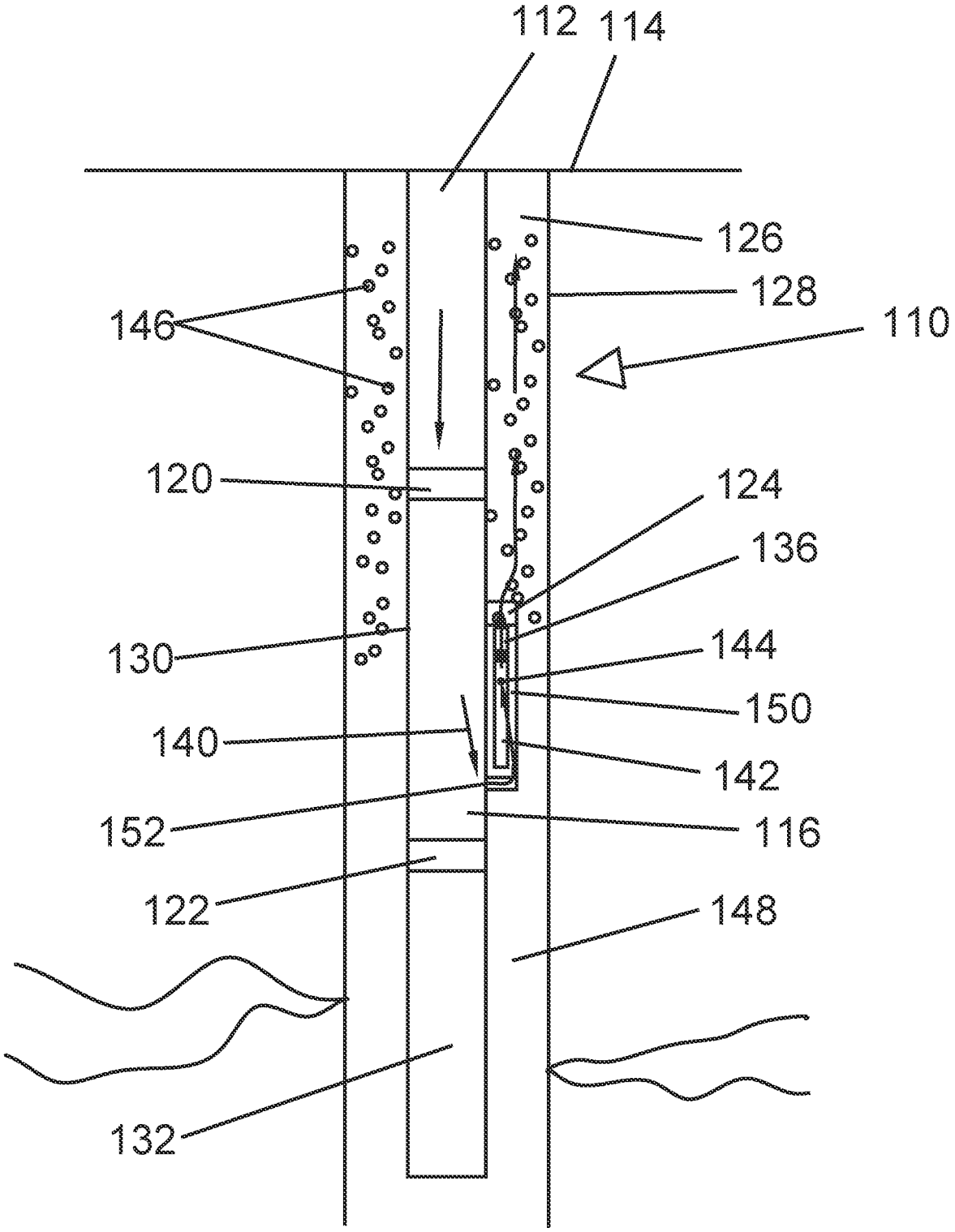
FIG. 2 depicts a gas lift system using high pressure gas injected into the interior of the production tubular to assist in moving fluids in the annular region to the surface.

FIG. 2 depicts a gas lift system 110 where a production tubular 112 running from the surface 114 has a gas lift mandrel 116 assembled into the production tubular 112 using collars 120 and 122. The gas lift mandrel 116 includes a gas tight external chamber 150. The gas tight external chamber 150 is attached to the gas lift mandrel 116 and provides a port 152 to allow gas inside the gas lift mandrel 116 to flow through the port 152 and into the interior of the gas tight external chamber 150. Gas in the external gas tight chamber 150 is then forced into gas lift valve 142 via port 144. The gas then continues on to check valve 136 where the gas causes the check valve 136 to open further allowing the gas access to port 124 which then provides access to the annular region 126, between the casing 128 and the exterior of the production tubular 130. The check valve 136 is a one-way valve that is oriented to prevent oil or gas, including high-pressure gas, from flowing from the annular region 126 and into the gas tight external chamber 150 thereby preventing oil or gas from flowing from the annular region 126 to the interior of the production tubular 132.

In operation this particular configuration of the gas lift system 110 utilizes high-pressure gas as depicted by arrow 140 injected into the interior of the production tubular 132. The high-pressure gas then flows into gas lift mandrel 116 and thereafter through port 152 and into the gas tight external chamber 150. The gas tight external chamber 150 forces the high-pressure gas to surround both the check valve 136 and the gas lift valve 142. The high-pressure gas then flows into the interior of the gas lift valve 142 through ports 144. The gas lift valve 142 further directs the high-pressure gas into the interior of check valve 136. The high-pressure gas causes check valve 136 to open allowing the flow of high pressure gas from the interior of the production tubular 132 to the annular region 126 while preventing oil or gas from flowing from the annular region 126 to the interior of the production tubular 132. As the high-pressure gas enters the annular region 126 areas of lower density or bubbles 146. The bubbles 146 are utilized to reduce the column of fluid 148 within the annular region 126 so that the natural reservoir pressure may lift the column of fluid 148 and bubbles 146 to the surface.

Figure 3:
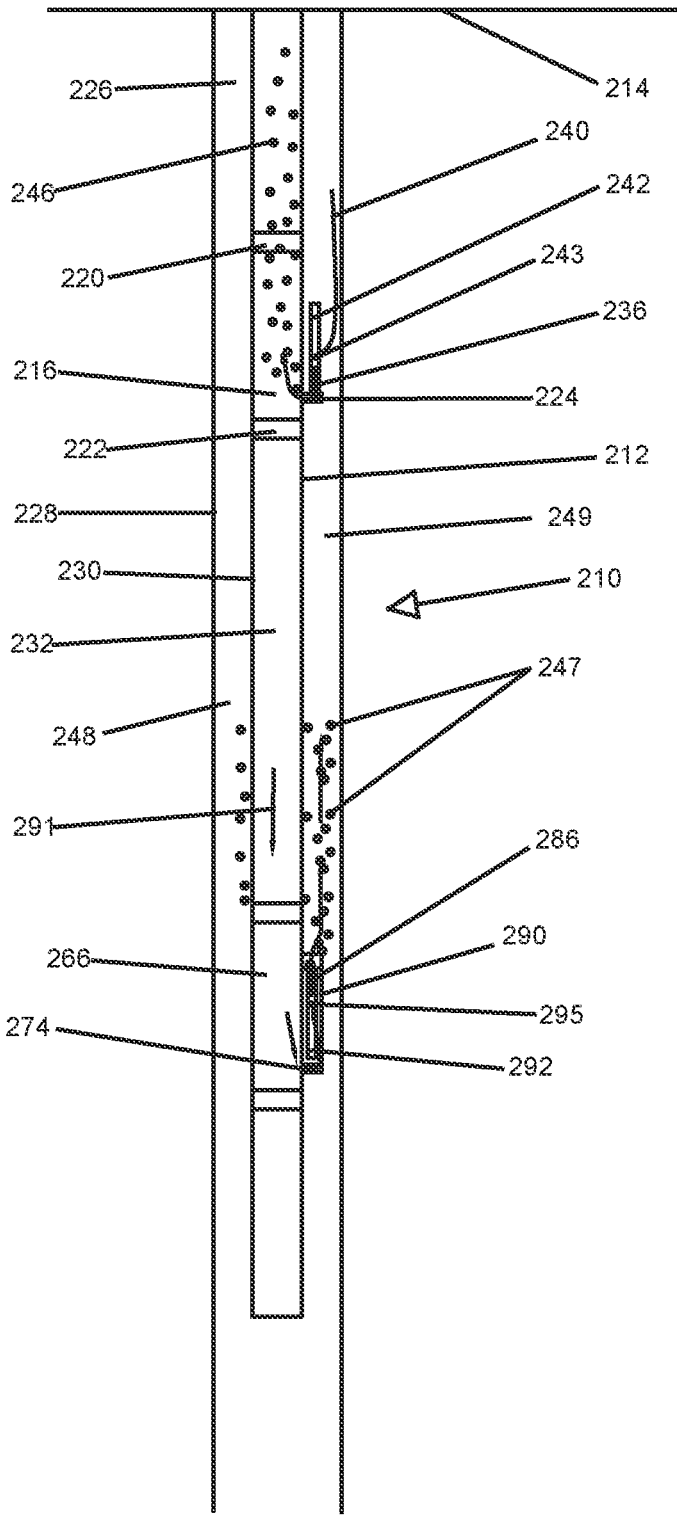
FIG. 3 depicts a gas lift system using both high pressure gas injected into the annular area to assist in moving fluids in the interior of the tubular to the surface and using high pressure gas injected into the interior of the production tubular to assist in moving fluids in the annular region to the surface.

FIG. 3 is an embodiment of the current invention where either the high-pressure gas may be injected into the production tubular to lift fluid through the annular region or, as desired, the high-pressure gas may be injected into the annular region allowing fluid within the production tubular to be lifted to the surface. The operator may switch between one direction or the other without pulling the production tubular or running a wireline system into the well to change out to gas lift valves.

The gas lift system in FIG. 3 includes a first mandrel 216 configured to allow a gas lift valve 242 and a check valve 236 to be attached providing for high-pressure gas to be injected from the annular region 226 into the interior of the production tubular 232. The gas lift system 210 also includes a second gas lift mandrel 266 provided with an external chamber 290 to allow a gas lift valve 292 and a check valve 286 to be attached that provide for high-pressure gas to be injected from the interior the production tubular 232 into the annular region 226 of the well which may be cased or open hole.

More specifically the gas lift system 210 includes a production tubular 212 running from the surface 214. The production tubular 212 has a first gas lift mandrel 216 assembled into the production tubular 212 using collars 220 and 222 and a second gas lift mandrel 266 also assembled into the production tubular 212. While only a first and a second gas lift mandrel are depicted is envisioned that numerous gas lift mandrels will be used within a single well. The first gas lift mandrels and second gas lift mandrels may be spaced consecutively or may be interspersed with one another.

The first gas lift mandrel 216 includes a port 224 that provides access from the annular region 226, between the casing 228 and the exterior of the production tubular 230, to the interior of the production tubular 232. The check valve 236 is attached to port 224 and is a one-way valve that is oriented at the first gas lift mandrel 216 to prevent oil or gas, including high-pressure gas, from flowing through the first gas lift mandrel 216 and port 224 from the interior of the production tubular 232 to the exterior of the production tubular 230 while allowing the flow of fluid or gas from the annular region 226 to the interior of the production tubular 232. A gas lift valve 242 is attached to check valve 236. Port 224, check valve 236, and gas lift valve 242 form a gas or fluid pathway between the interior of the production tubular 232 and annular region 226.

The second gas lift mandrel 266 includes a port 274 that provides access between the interior of the production tubular 232 through port 274 and a gas tight external chamber 290 such that the fluid and gas flow path between the interior of the gas lift mandrel 266 and the annular region 226, between the casing 228 and the exterior of the production tubular 230, goes through port 274, gas tight external chamber 290, into gas lift valve 292, check valve 286, through a second port in the gas tight external chamber 290, and then into the annular region 226. The check valve 286 is a one-way valve that is oriented at the second gas lift mandrel 266 to prevent oil or gas, including high-pressure gas, from flowing from the annular region 226 and into the gas tight external chamber 290 which also precludes the flow of fluids into the interior of the production tubular 232 via gas lift mandrel 266 while allowing the flow of fluid or gas from the interior of the production tubular 232 through the gas tight external chamber 290, gas lift valve 292, and check valve 286 to the annular region 226. Port 274, check valve 286, and gas lift valve 292 form a gas or fluid pathway between the annular region 226 and the interior of the production tubular 232.

In operation the operator may determine some point that gas lift is required to produce well fluid, which is typically a hydrocarbon water mix, through the interior of the production tubular 232 to the surface 214. In this instance high-pressure gas as depicted by arrow 240 is injected into the annular region 226. The high-pressure gas will generally have a flowpath to both the exterior of the first gas lift mandrel 216 and the exterior of the second gas lift mandrel 266. The high-pressure gas that reaches the second mandrel 266 has a flowpath through check valve 286, gas lift valve 292, the gas tight external chamber 290, and port 274. However at the second mandrel 266 the check valve 286 is oriented to prevent the high-pressure gas or other fluids from flowing from the annular region 226 and into the flowpath that includes the gas tight external chamber 290. The high-pressure gas that reaches the first mandrel 216 has a flowpath into port 243 and into gas lift valve 242. Gas lift valve 242 then directs the high-pressure gas into check valve 236 which in this case is oriented to allow the high-pressure gas to flow through the check valve 236 and further through port 224 into the interior of the first gas lift mandrel 216 which is part of production tubular 232. As the high-pressure gas enters the interior of the production tubular 232 bubbles 246 are formed by the high-pressure gas within the fluid. The bubbles 246 reduce the density of the column of fluid 248 within interior of the production tubular 232 so that the natural reservoir pressure may lift the column of fluid 248 and the bubbles 246 to the surface.

In contrast the operator may determine some point that gas lift is required to produce well fluid through the annular region 226 to the surface 214. In this instance high-pressure gas as depicted by arrow 291 is injected into the interior of the production tubular 232. In this instance the high-pressure gas will generally have a flowpath to both the interior of the first gas lift mandrel 216 and the interior of the second gas lift mandrel 266. The high-pressure gas that reaches the first gas lift mandrel 216 has a flowpath through port 224, check valve 236, and gas lift valve 242. However at the first gas lift mandrel 216 the check valve 236 is oriented to prevent the high-pressure gas or other fluids from flowing from the interior of the production tubular 232 and into the flowpath that includes the gas lift valve 242. The high-pressure gas that reaches the second gas lift mandrel 266 has a flowpath into port 274, gas tight external chamber 290, gas lift valve 292, and check valve 286. As the high-pressure gas flows from the interior of the production tubular 232 it flows through the port 274 and into the interior of the gas tight external chamber 290. The gas tight external chamber 290 then causes the high-pressure gas to flow through port 295 and into the interior of gas lift valve 292. Gas lift valve 292 then directs the high-pressure gas into check valve 286, provided that the high-pressure gas has sufficient pressure to open the gas lift valve. Check valve 236 is oriented to allow the high-pressure gas to flow through the check valve 236 and into the annular region 226. As the high-pressure gas enters the interior of the annular region 226 bubbles 247 are formed by the high-pressure gas within the fluid. The bubbles 247 reduce the density of the column of fluid 249 and within the annular region 226 so that the natural reservoir pressure may lift the column of fluid 248 and the bubbles 246 to the surface.

Figure 4:
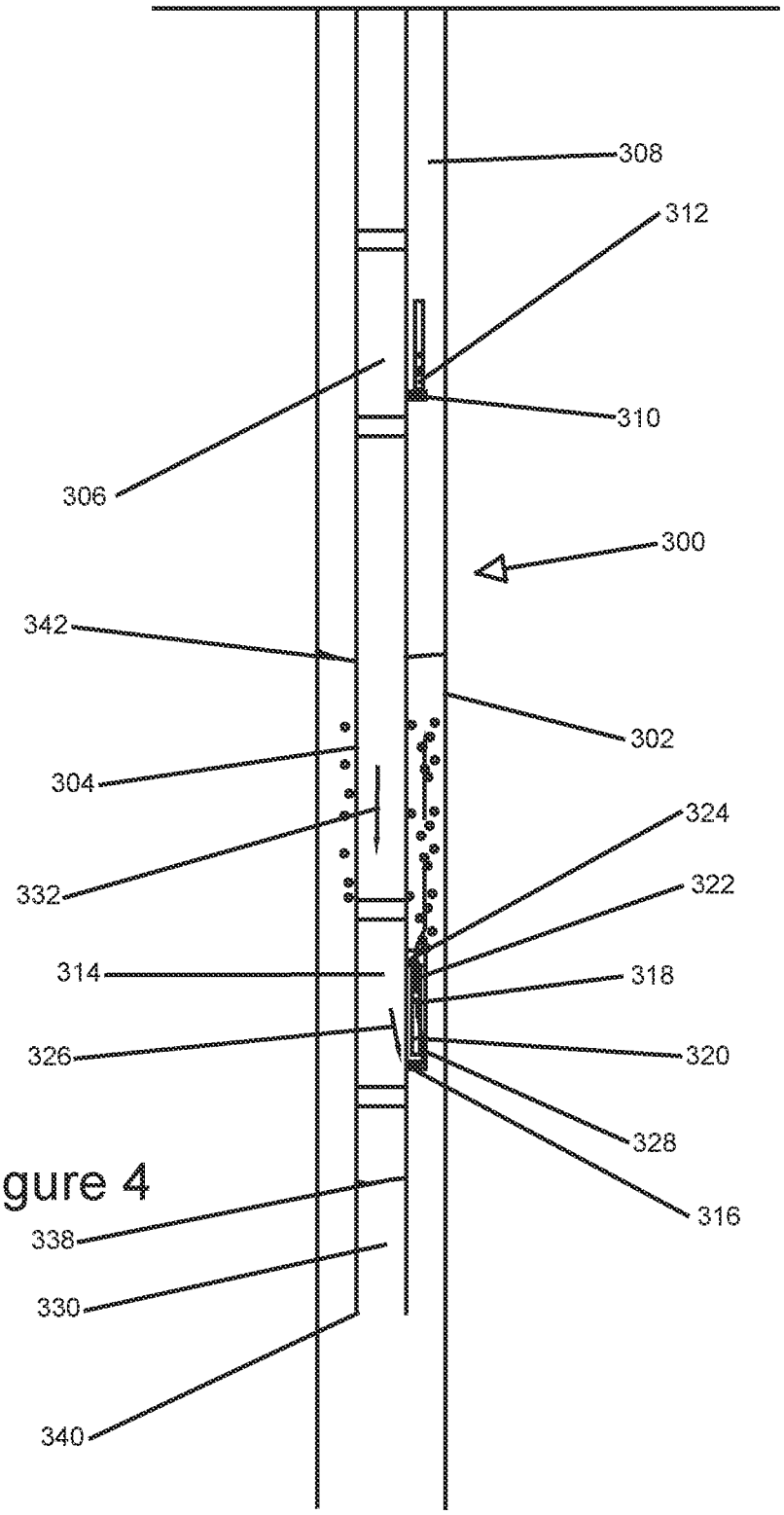
FIG. 4 depicts a packer less and plug less gas lift system injecting gas into the annular region.

FIG. 4 depicts a packer less and plug less gas lift system in the configuration shown the well 300 has a casing 302 and a production tubular 304 the production tubular 304 includes a first mandrel 306. The first mandrel 306 includes a port 310 that allows fluid and/or gas access from the interior the production tubular 304 to the annular area 308 between the interior of casing 302 and the exterior of the production tubular 304. The port 310 is adapted to accept check valve 312 where check valve 312 is configured to allow one-way fluid flow from the annular area 308 to the interior of mandrel 306 while preventing fluid flow from the interior mandrel 306 to the annular area 308.

The production tubular 304 also includes a second mandrel 314 including a port 316. The port 316 is adapted to provide fluid access to chamber 318. Chamber 318 is adapted to incorporate gas lift valve 320 and check valve 322 such that fluid entering the chamber through port 316 is directed into gas lift valve 320 and then into check valve 322 and finally into port 324. Where port 324 allows fluid access from check valve 322 through port 324 and into annular area 308. The gas flow from the interior of the second mandrel 314 through port 316 into chamber 318 then into gas lift valve 320, through check valve 322, through port 324 and finally into the hydrocarbons in the annular area 308 is depicted by arrows 326 and 328.

As can be seen in FIG. 4 production tubular 304 does not include a plug below mandrel 314. In this configuration the operator relies on produced fluids 330 within production tubular 304 having sufficient pressure to provide a gas tight seal and forcing any pressurized gas as depicted by arrow 332 within the production tubular 304 to flow through port 316 and ultimately out of port 324 before pushing the fluid gas interface 338 below the lower end 340 of production tubular 304. As gas is injected into the annular region 308 through ports 316 and 324 the produced fluid and the annular region 308 is transported to the surface causing a reduction in the fluid pressure below the gas fluid interface 338. As more of the produced fluid is moved to the surface eventually the gas fluid interface 338 moves to the lower end 340 of the production tubular 304 with the gas fluid interface 338 below the lower end 340 of production tubular 304 the pressurized gas within the production tubular 304 escapes around the lower end 340 the production tubular 300 for into the annular area 308 stopping the produced fluid from moving to the surface.

Figure 5:
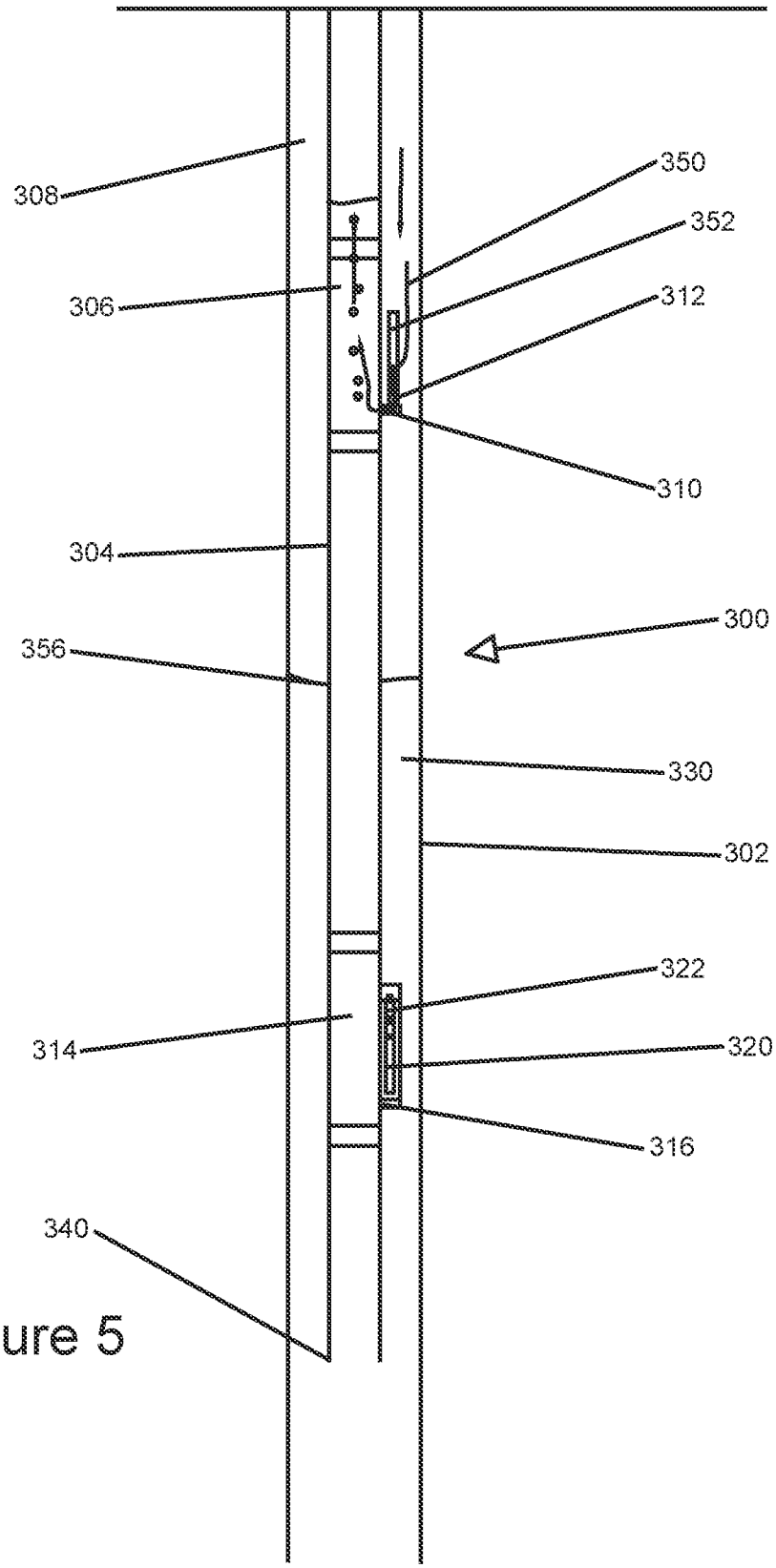
FIG. 5 depicts a packer less and plug less gas lift system injecting gas into the production tubular.

With annular production stopped the gas flow is reversed as indicated in FIG. 5. Again the operator relies on produced fluids 330 now in the annular area 308 having sufficient pressure to provide a gas tight seal and forcing any pressurized gas as depicted by arrow 350 within the annular area 308 to flow into gas lift valve 352. The pressurized gas then flows from gas lift valve 352 into check valve 312 which is oriented to allow gas to flow from the gas lift valve 352 into port 310 and then into the interior of mandrel 306.

As gas is injected into the interior of mandrel 306 and thus into production tubular 304 through port 310 the produced fluid within the interior of mandrel 306 and production tubular 304 is transported to the surface causing a reduction in the fluid pressure below the second gas fluid interface 356. As more of the produced fluid is moved to the surface eventually the second gas fluid interface 356 moves to the lower end 340 of the production tubular 304. Once the second gas fluid interface 356 reaches the lower end 340 of production tubular 304 the pressurized gas within the annular area 308 escapes around the lower end 340 the production tubular into the production tubular 304 stopping the produced fluid from moving to the surface.

Figure 6:
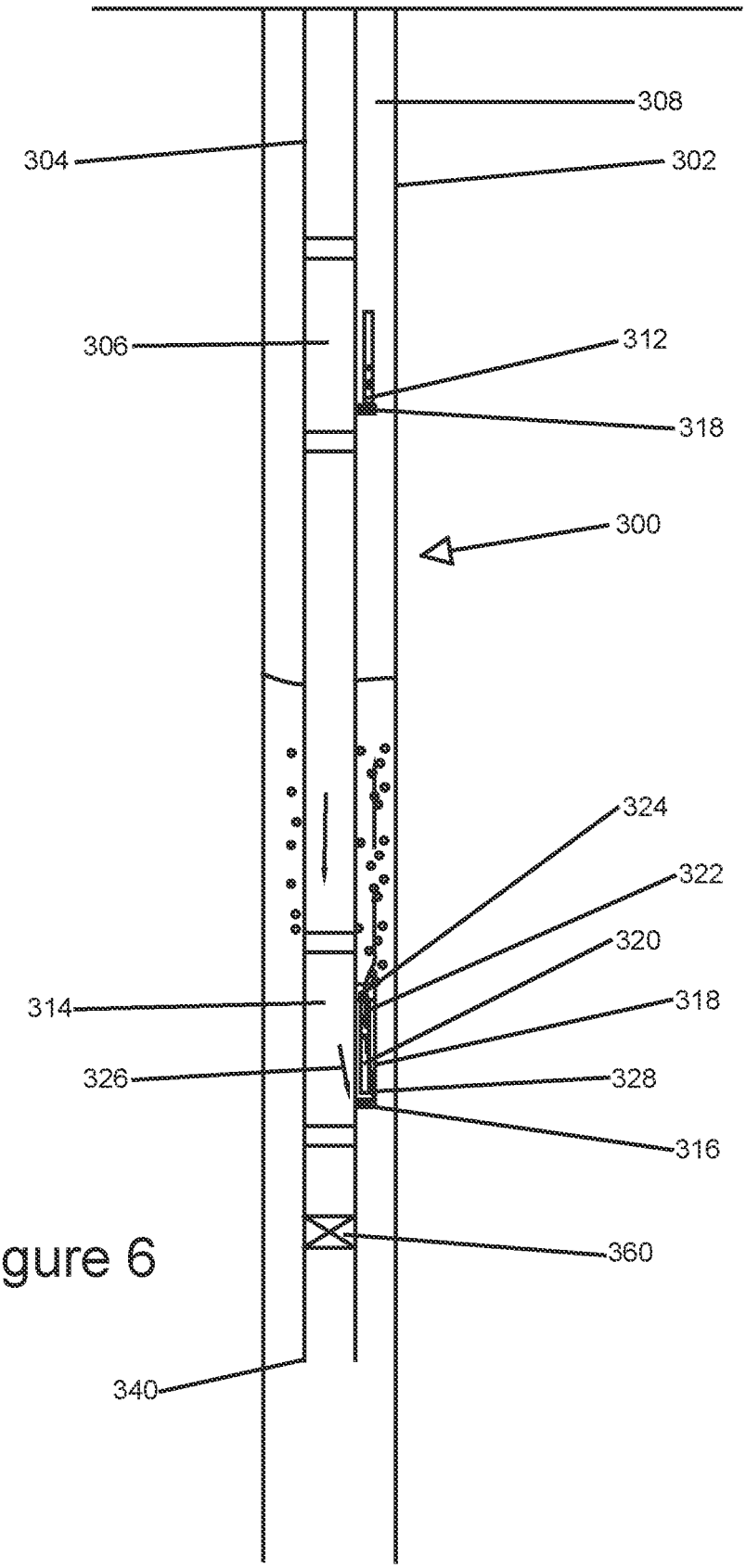
FIG. 6 depicts a gas lift system injecting gas into the annular region having a packer in place.

FIG. 6 depicts a variation on the system described in FIG. 4. As before and the well 300 has a casing 302 and a production tubular 304 the production tubular 304 includes a first mandrel 306. The first mandrel 306 includes a port 310 that allows fluid and/or gas access from the interior the production tubular 304 to the annular area 308 between the interior of casing 302 and the exterior of the production tubular 304. The port 310 is adapted to accept check valve 312 where check valve 312 is configured to allow one-way fluid flow from the annular area 308 to the interior of mandrel 306 while preventing fluid flow from the interior mandrel 306 to the annular area 308.

The production tubular 304 also includes a second mandrel 314 including a port 316. The port 316 is adapted to provide fluid access to chamber 318. Chamber 318 is adapted to incorporate gas lift valve 320 and check valve 322 such that fluid entering the chamber through port 316 is directed into gas lift valve 320 and then into check valve 322 and finally into port 324. Where port 324 allows fluid access from check valve 322 through port 324 and into annular area 308. The gas flow from the interior of the second mandrel 314 through port 316 into chamber 318 then into gas lift valve 320, through check valve 322, through port 324 and finally into the hydrocarbons in the annular area 308 is depicted by arrows 326 and 328.

As can be seen in FIG. 6 however production tubular 304 now includes a plug 360 below mandrel 314. In this configuration the operator relies on plug 360 within production tubular 304 to provide a gas tight seal and forcing any pressurized gas as depicted by arrow 332 within the production tubular 304 to flow through port 316 and ultimately out of port 324. In the configuration including plug 360 higher gas pressures may be included within production tubular 304 providing higher rates of gas flow through port 24 and into the produced fluids increasing the rate of production of fluids to the surface. At some point there will be insufficient hydrocarbons or produced fluid available in the annular area for the annular lift system to function. Upon reaching the point where annular lift no longer functions the plug 360 is removed, typically by wireline. In some instances the plug 360 may remain within the production tubular 304 provided that fluid access is facilitated between the interior of the production tubular 304 and the hydrocarbons or produced fluids below the plug 360. Some examples of fluid access through or around the plug may be where fluid access is provided by one or more burst disks. The burst disk may be provided within the plug or in the subassembly sitting above the plug where the burst disks are directed radially outward. In other instances a wireline tool may simply puncture the plug rather than removing the plug, while an even other instances pressure cycles may shift a portion of the plug to provide fluid access through or around the plug.

Figure 7:
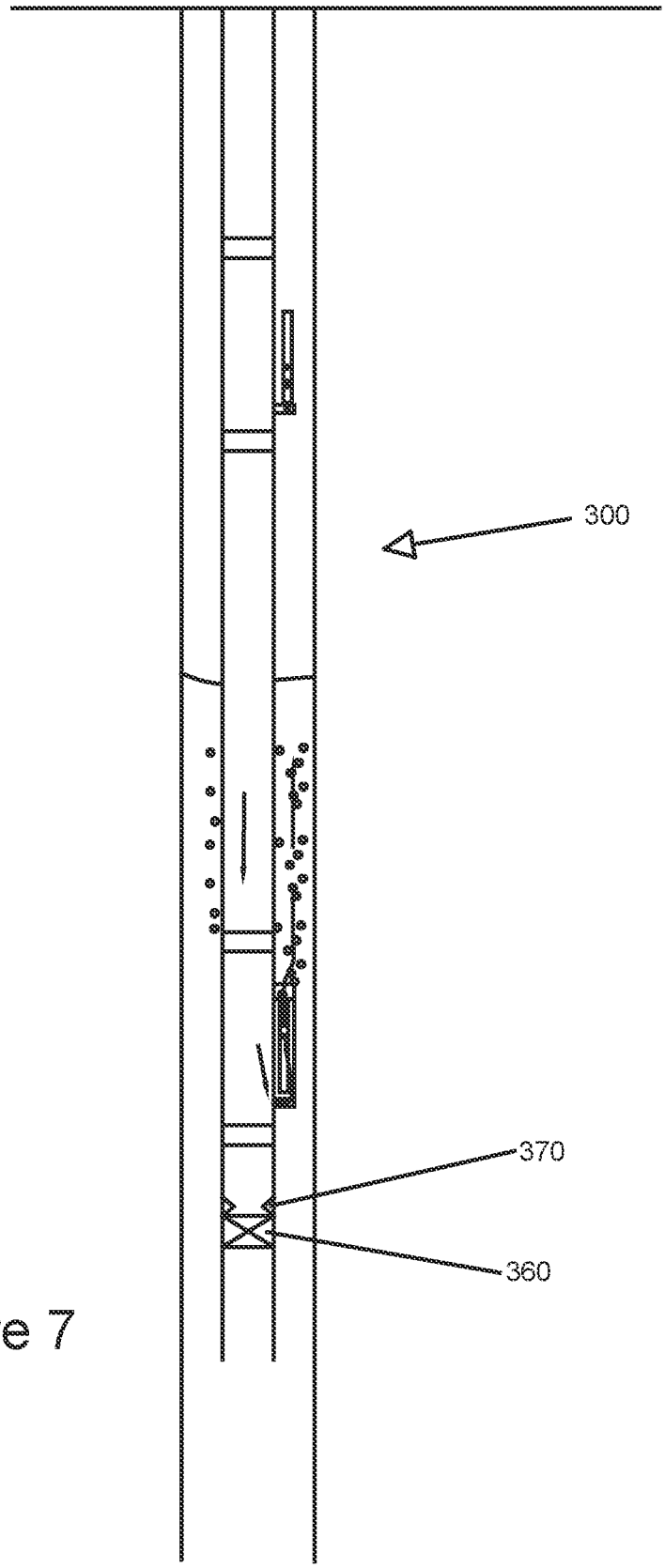
FIG. 7 depicts a gas lift system injecting gas into the annular region having a packer and landing nipple in place.

In some instances, as depicted in FIG. 7, it may be desirable to provide a landing nipple 370 above the plug 360. The landing nipple 370 may be useful for landing a second plug or other tooling as desired by the operator.

Figure 8:
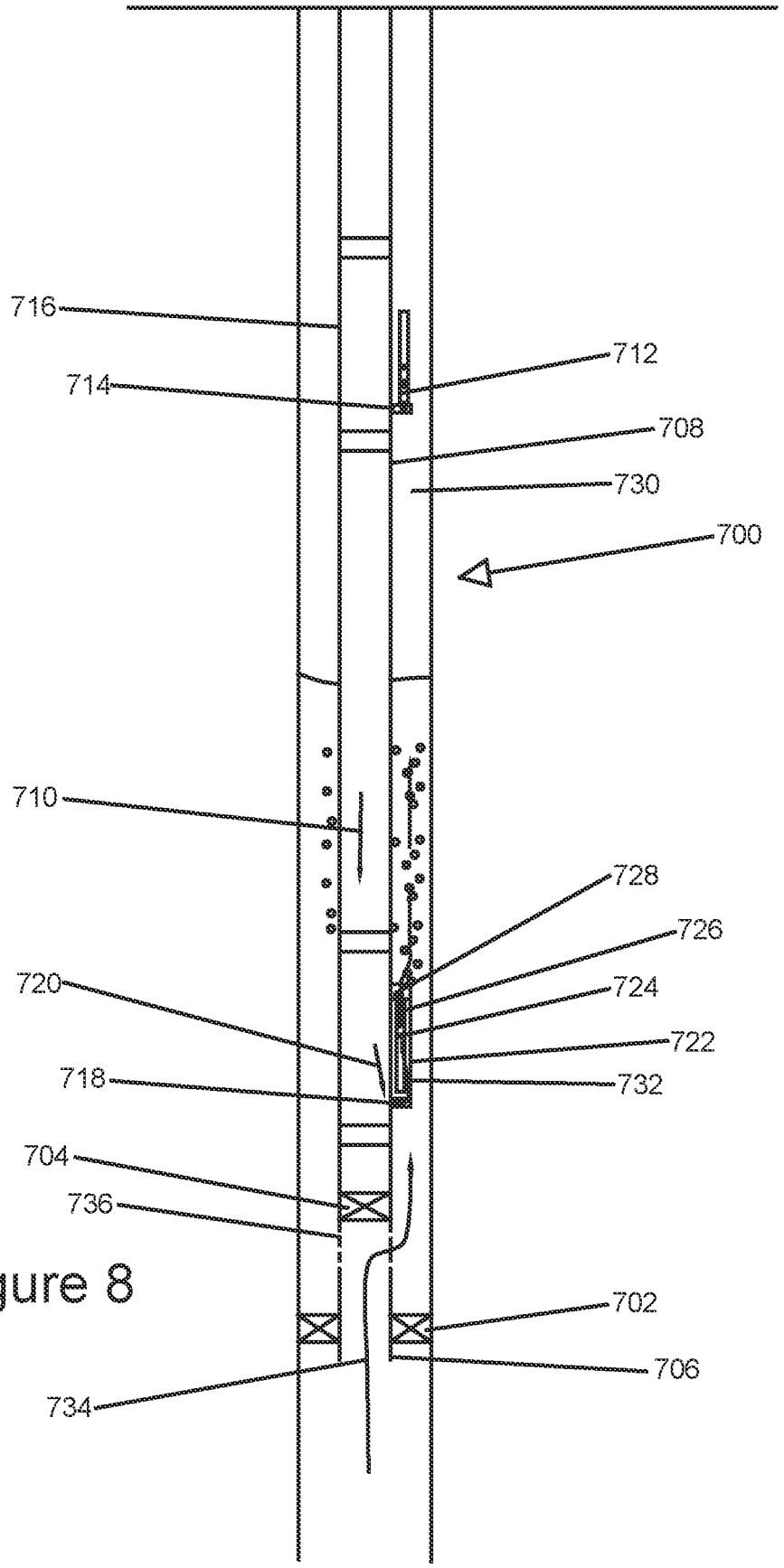
FIG. 8 depicts a reversible gas lift system with both a packer and plug at the lower end of the production tubular.

FIG. 8 depicts a reversible gas lift system 700 with both a packer 702 and plug 704 at the lower end 706 of the production tubular 708. Initially gas will be injected into the interior of the production tubular 708 as indicated by arrow 710. Check valve 712 prevents the gas from exiting through port 714 in mandrel 716. Plug 704 prevents the gas from exiting through the lower end 706 of the production tubular 708. The gas must then exit through port 718 in mandrel 720. The gas then flows from port 718 to the interior of chamber 722 where then flows into the inlet of gas lift valve 724 into check valve 726 through port 728 and into the annular area 730 as indicated by arrow 732. Port 728 connects the interior of chamber 722 with the annular area 730. Packer 702 isolates the annular area 730 from the lower end of the well forcing the wellbore fluid to enter the lower end 706 of production tubular 708. The wellbore fluid then enters the annular area 730 through ports 736 in the production tubular below plug 704 as indicated by arrow 734. Port or ports 736 may simply be a ported sub assembled into the production tubular.

Figure 9:
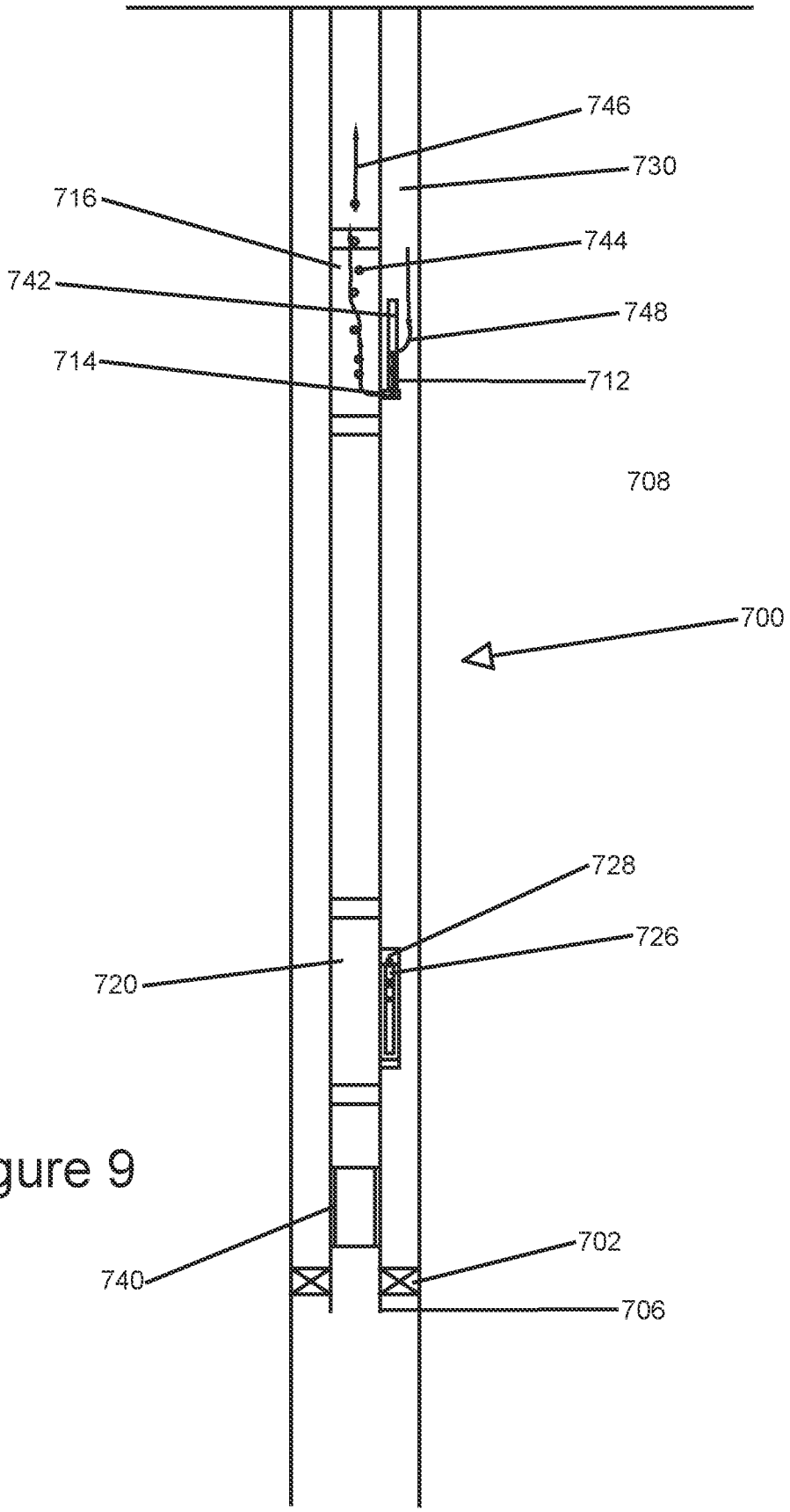
FIG. 9 depicts a reversible gas lift system with an isolation sub straddling ports in the production tubular.

At some point within the life of the well the operator will change the well from annular lift to production tubular lift where gas is injected into the annular region and fluids are produced to the surface through the production tubular 708 as indicated in FIG. 9. In order to facilitate the switchover, fluid access will have to be provided through plug 704 (from FIG. 8). In many instances a wireline tool will be run into the production tubular to latch onto plug 704 and remove it to the surface. In other instances the plug may be released so they can fall to the bottom of the well. In other instances a simple burst disk may be burst to allow fluid access below the plug 704. As indicated the plug 704 has been removed from the production tubular 708. With plug 704 removed an isolation tool 740 is run into the well and located within the production tubular so that the isolation tool 740 straddles ports 736 and is then set so that the isolation tool 740 will prevent fluid flow between the annular area 730 and the interior the production tubular 708 through ports 736. With ports 736 now closed gas may be injected into the annular area 730 where packer 702 prevents the gas from exiting the annular area into the wellbore below the lower end 706 of production tubular 708. Previously in the annular lift configuration pressurized gas entered into the annular area 706 through port 728. In production tubular lift check valve 726 prevents flow into production tubular 708. The pressurized gas is then forced into gas lift valve 742 after which interest check valve 712 which allows the gas to flow into port 714 and finally into the interior of mandrel 716, as indicated by arrows 748. Mandrel 716 is part of production tubular 708. The gas that is been injected into the interior of production tubular 708 reduces the overall density of the fluid within the production tubular as indicated by bubbles 744 allowing the fluid to be to produced to the surface as indicated by arrow 746.

Figure 10:
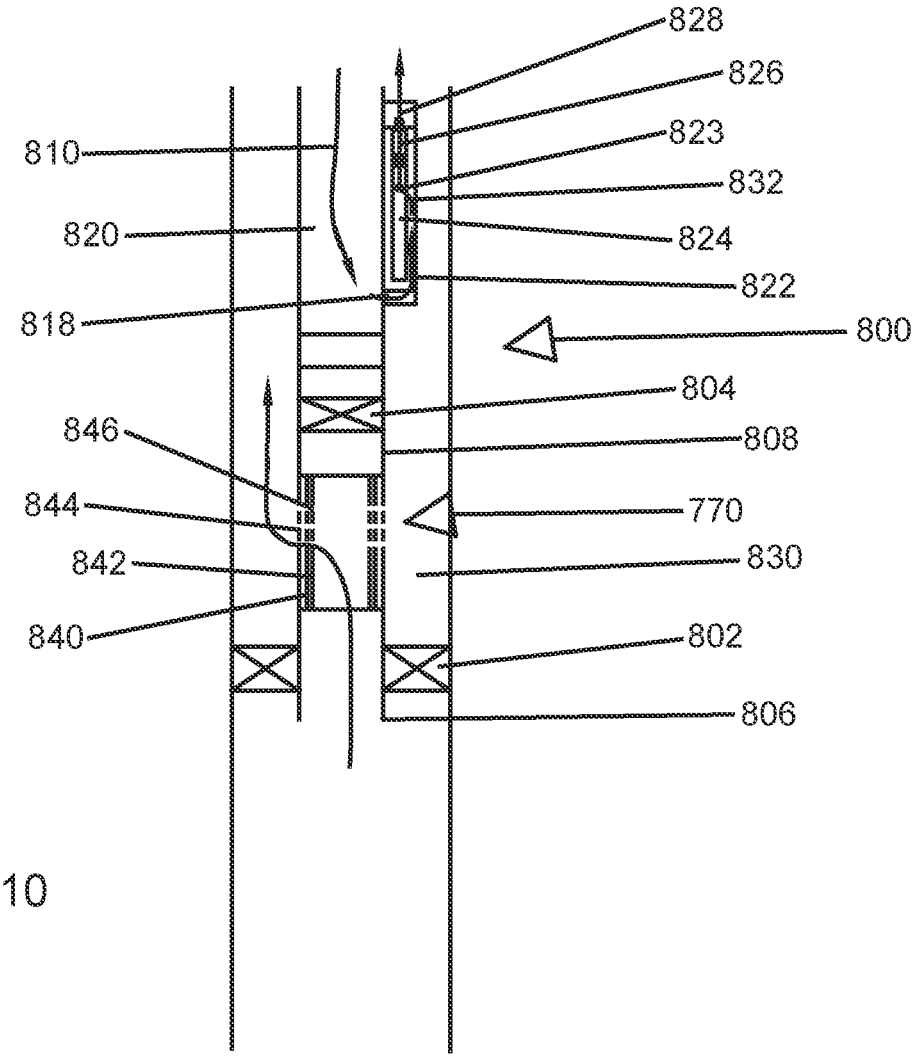
FIG. 10 depicts a lower portion of an alternate embodiment of a reversible gas lift system having a sliding sleeve.

FIG. 10 depicts a lower portion of an alternate embodiment of a reversible gas lift system wherein the ports 736 from FIGS. 8 and 9 are replaced with a sliding sleeve assembly 770. As before the reversible gas lift system 800 includes a packer 802 and plug 804 at the lower end 806 of the production tubular 808. Initially gas will be injected into the interior of the production tubular 808 as indicated by arrow 810. Plug 804 prevents the gas from exiting through the lower end 806 of the production tubular 808. The gas must then exit the interior of the production tubular 808 through port 818 in mandrel 820. The gas then flows from port 818 to the interior of chamber 822 where it then flows into the inlet 823 of gas lift valve 824 into check valve 826 through port 828 and into the annular area 830 as indicated by arrow 832. Port 828 connects the interior of chamber 822 with the annular area 830. Packer 802 isolates the annular area 830 from the lower end of the well forcing the wellbore fluid to enter the lower end 806 of production tubular 808. The wellbore fluid flows upward into the production tubular 808 entering sliding sleeve assembly 770. The wellbore fluid is prevented from flowing any further upwards in the production tubular 808 by plug 804. However the sliding sleeve assembly 770 includes a housing 840 and an inner sleeve 842 where the housing 804 includes ports 844 and the inner sleeve 842 includes ports 846. In the run in or open position ports 844 and 846 are aligned allowing fluid access between an interior of the sliding sleeve assembly 770 and the annular area 830 such that the wellbore fluid which is entered the lower end of the production tubular 888 and then the interior the sliding sleeve assembly 770 may continue upwards in the annular area 830 by passing through ports 844 and 846.

Figure 11:
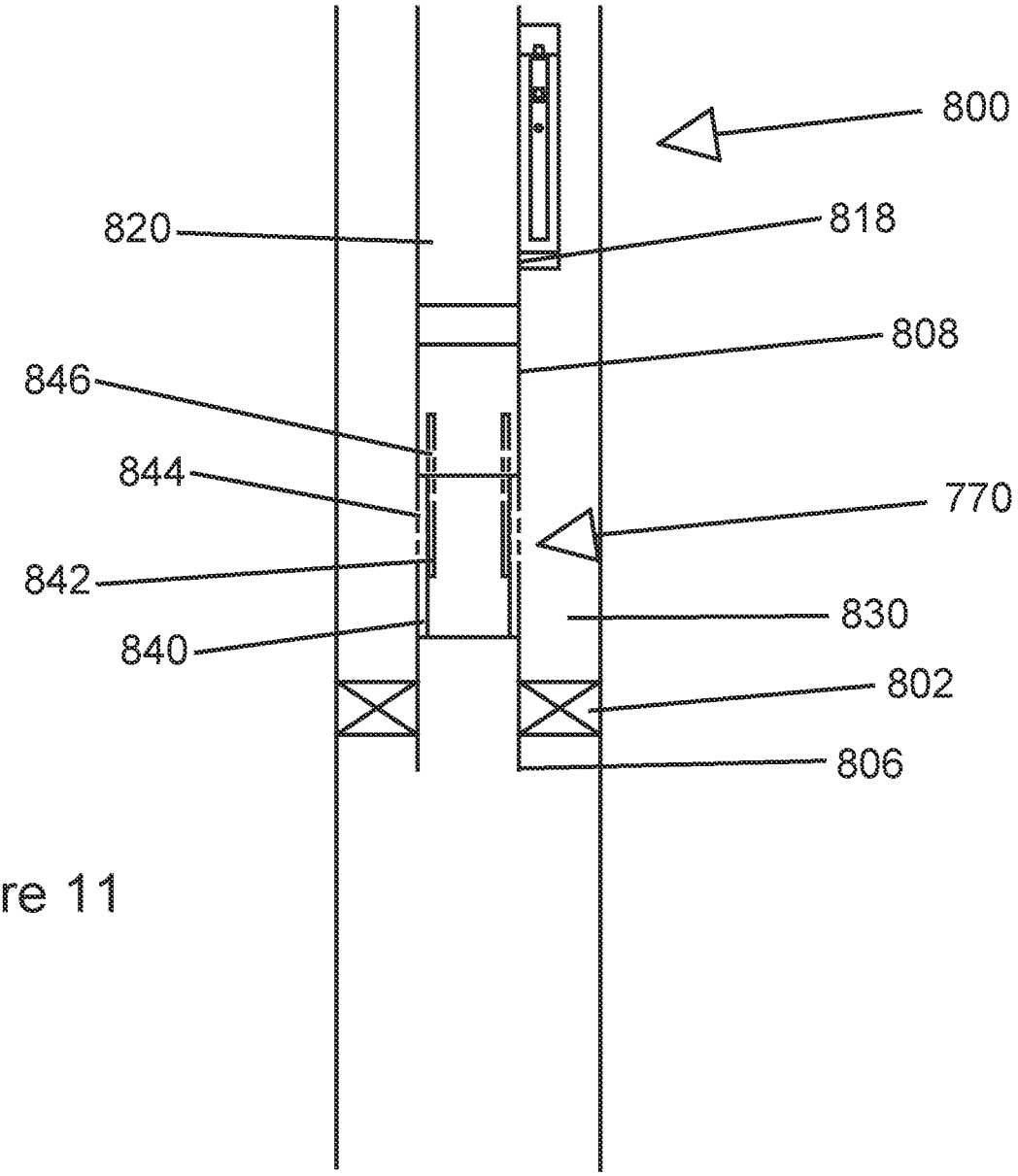
FIG. 11 depicts a configuration of the gas lift system including a sliding sleeve assembly in the closed position.

FIG. 11 depicted configuration of the gas lift system 800 including sliding sleeve assembly 770 in the closed position. When it is required to change the production of wellbore fluids from annular lift to production tubular lift, as before fluid access is provided through the interior of the production tubular 808 past plug 804. With fluid access past plug 804 the inner sleeve 842 is shifted so that ports 844 in the housing 840 and ports 846 in the inner sleeve 842 are no longer aligned wherein fluid access between the interior of the production tubular 808 and the annular area 830 is prevented allowing pressurized gas to be injected into the annular area 830 where packer 802 prevents the gas from exiting the annular area 830 into the wellbore below the lower end 806 of production tubular 808. Where the pressurized gas is then injected into the interior of the production tubular 808 reducing the overall density of the wellbore fluids and allowing the wellbore fluids to be to produced to the surface.

Figure 12:
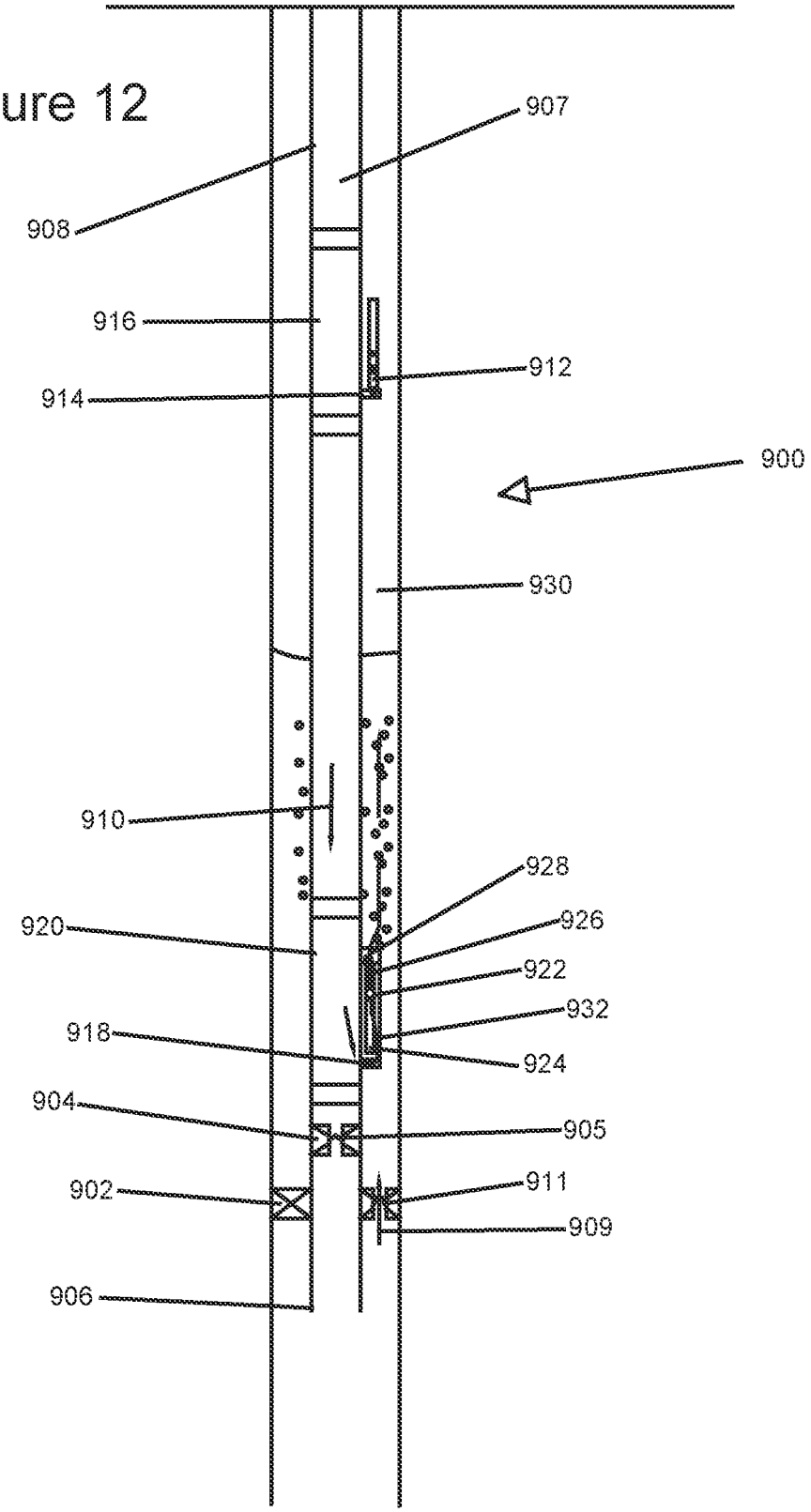
FIG. 12 depicts a reversible gas lift system having a packer with a one-way valve and plug at the lower end of the production tubular.

FIG. 12 depicts a reversible gas lift system 900 having a packer 902 and plug 904 at the lower end 906 of the production tubular 908. Initially gas will be injected into the interior of the production tubular 908 as indicated by arrow 910. Check valve 912 prevents the gas from exiting through port 914 in mandrel 916. Plug 904 is equipped with a one-way valve 905. Together plug 904 and one-way valve 905 prevent the flow of fluids or gas from the upper region 907 of the production tubular past the plug 904 and one-way valve 905 towards the lower end 906 of the production tubular 908. The one-way valve may be a check valve, a poppet valve, a flapper valve or other one-way valve. With the other potential pathways blocked the gas exits through port 918 in mandrel 920. The gas then flows from port 918 to the interior of chamber 922 where the gas then flows into the inlet of gas lift valve 924 into check valve 926 through port 928 and into the annular area 930 as indicated by arrow 932. Packer 902 is also equipped with a one-way valve 911. In this instance the one-way valve 911 allows fluid below packer 906 to pass through the one-way valve 911 as indicated by arrow 909 and enter the annular region 930 where the fluids are injected with the gas flowing out of port 928 so that the fluids may be produced to the surface.

Figure 13:
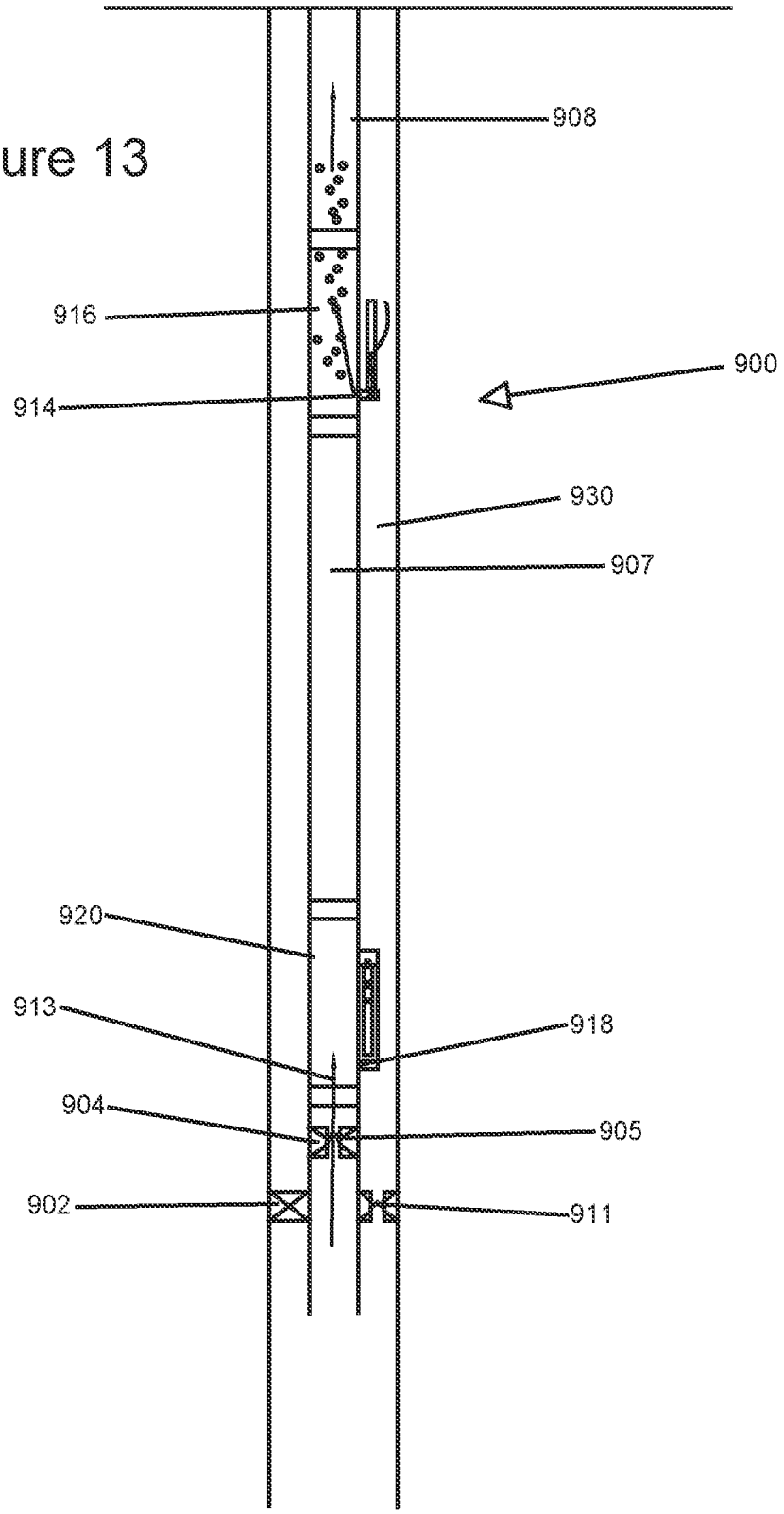
FIG. 13 depicts the system from FIG. 12 in tubular lift flow.

FIG. 13 depicts the system from FIG. 12 when tubular lift flow or reverse flow is desired. Gas is injected into the annular region 930 and fluids are produced to the surface through the production tubular 908. In this instance no further action by the operator is required as one-way valve 911 closes in the presence of flow from the annular region 930 towards the lower end 906 of production tubular 908 to prevent the downward flow of gas or fluid out of the annular region 930 while one-way valve 905 opens to allow the produced or other fluids below the plug 904 to move upwards past plug 904 as indicated by arrow 913 where the fluids are injected with gas thorough port 914 and produced to the surface.

The methods and materials described as being used in a particular embodiment may be used in any other embodiment. While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A device for lifting fluid from a well comprising:

a production tubular having a first gas lift mandrel and a second gas lift mandrel; wherein the first gas lift mandrel does not include a chamber;

the first gas lift mandrel having a first gas lift valve mounted on an exterior of the first gas lift mandrel oriented to allow gas or fluid to flow from the exterior of the first gas lift mandrel to an interior of the first gas lift mandrel;

the second gas lift mandrel having a chamber mounted on an exterior of the second gas lift mandrel and a second gas lift valve within the chamber oriented to allow gas or fluid to flow from an interior of the second gas lift mandrel through the chamber and a check valve to an annulus of the wellbore.

* * * * *